US006329581B1

(12) United States Patent
Negin

(10) Patent No.: US 6,329,581 B1
(45) Date of Patent: Dec. 11, 2001

(54) STRINGED INSTRUMENT NECK HAVING FINGER SLOTS

(76) Inventor: Nosson Negin, 15 Portland Avenue, London N16 6HA (GB)

( * ) Notice: Subject to any disclaimer, the term of this patent is extended or adjusted under 35 U.S.C. 154(b) by 0 days.

(21) Appl. No.: 09/827,749

(22) Filed: Apr. 6, 2001

(51) Int. Cl.[7] ..... G10D 3/00
(52) U.S. Cl. ..... 84/293; 84/267
(58) Field of Search ..... 84/293, 269, 267, 84/268, 297 R, 290

(56) References Cited

U.S. PATENT DOCUMENTS

| | | | | |
|---|---|---|---|---|
| D. 279,195 | | 6/1985 | Perkins . | |
| 2,087,631 | | 7/1937 | Simpson . | |
| 4,200,023 | | 4/1980 | Kaman . | |
| 4,221,151 | * | 9/1980 | Barth | 84/314 R |
| 4,291,606 | | 9/1981 | Lapage . | |
| 4,616,550 | | 10/1986 | Lacroix et al. . | |
| 4,777,858 | * | 10/1988 | Petschulat et al. | 84/314 R |
| 4,785,705 | | 11/1988 | Patterson . | |
| 5,325,757 | * | 7/1994 | Ghenea | 84/314 R |

* cited by examiner

*Primary Examiner*—Robert E. Nappi
*Assistant Examiner*—Kim Lockett

(57) ABSTRACT

A stringed instrument neck having finger slots for facilitating fingering chords when playing a guitar includes a main body portion having a bridge. A neck extends from the main body portion and includes a front face, a first end, a head portion and a medical portion extending between the first end and the head portion. The first end is coupled to the main body portion. A plurality of strings are coupled between the bridge and the head portion. The strings are positioned to extend substantially parallel to each other along the neck. The neck includes a plurality of finger slots extending substantially parallel to the strings. Each of the finger slots is positioned between an associated adjacent pair of the strings such that the neck is designed for permitting insertion of fingers of a user through the finger slots for facilitating selective clamping of the strings against the neck by the fingers of the user.

10 Claims, 1 Drawing Sheet

STRINGED INSTRUMENT NECK HAVING FINGER SLOTS

BACKGROUND OF THE INVENTION

1. Field of the Invention

The present invention relates to stringed instruments and more particularly pertains to a new guitar neck having finger slots for facilitating fingering chords when playing a guitar.

2. Description of the Prior Art

The use of stringed instruments is known in the prior art. More specifically, stringed instruments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,291,606; U.S. Pat. No. 4,785,705; U.S. Pat. No. Des. 279,195; U.S. Pat. No. 4,200,023; U.S. Pat. No. 4,616,550; and U.S. Pat. No. 2,087,631.

While these devices fulfill their respective, particular objectives and requirements, the aforementioned patents do not disclose a new stringed instrument neck having finger slots. The inventive device includes a stringed instrument for facilitating fingering of musical chords. The stringed instrument includes a main body portion, which includes a bridge. A neck extends from the main body portion and includes a front face, a first end, a head portion and a medial portion extending between the first end and the head portion. The first end is coupled to the main body portion. A plurality of strings are coupled between the bridge and the head portion. The strings are positioned to extend substantially parallel to each other along the neck. The neck includes a plurality of finger slots extending substantially parallel to the strings. Each of the finger slots is positioned between an associated adjacent pair of the strings such that the neck is designed for permitting insertion of fingers of a user through the finger slots for facilitating selective clamping of the strings against the neck by the fingers of the user.

In these respects, the stringed instrument neck having finger slots according to the present invention substantially departs from the conventional concepts and designs of the prior art, and in so doing provides an apparatus primarily developed for the purpose of facilitating fingering chords when playing a guitar.

SUMMARY OF THE INVENTION

In view of the foregoing disadvantages inherent in the known types of guitars now present in the prior art, the present invention provides a new stringed instrument neck having finger slots construction wherein the same can be utilized for facilitating fingering chords when playing a guitar.

The general purpose of the present invention, which will be described subsequently in greater detail, is to provide a new stringed instrument neck having finger slots apparatus and method which has many of the advantages of the guitars mentioned heretofore and many novel features that result in a new stringed instrument neck having finger slots which is not anticipated, rendered obvious, suggested, or even implied by any of the prior art guitars, either alone or in any combination thereof.

To attain this, the present invention generally comprises a stringed instrument for facilitating fingering of musical chords. The stringed instrument includes a main body portion, which includes a bridge. A neck extends from the main body portion and includes a front face, a first end, a head portion and a medial portion extending between the first end and the head portion. The first end is coupled to the main body portion. A plurality of strings are coupled between the bridge and the head portion. The strings are positioned to extend substantially parallel to each other along the neck. The neck includes a plurality of finger slots extending substantially parallel to the strings. Each of the finger slots is positioned between an associated adjacent pair of the strings such that the neck is designed for permitting insertion of fingers of a user through the finger slots for facilitating selective clamping of the strings against the neck by the fingers of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stringed instrument neck having finger slots apparatus and method which has many of the advantages of the guitars mentioned heretofore and many novel features that result in a new stringed instrument neck having finger slots which is not anticipated, rendered obvious, suggested, or even implied by any of the prior art guitars, either alone or in any combination thereof.

It is another object of the present invention to provide a new stringed instrument neck having finger slots, which may be easily and efficiently manufactured and marketed.

It is a further object of the present invention to provide a new stringed instrument neck having finger slots which is of a durable and reliable construction.

An even further object of the present invention is to provide a new stringed instrument neck having finger slots which is susceptible of a low cost of manufacture with regard to both materials and labor, and which accordingly is then susceptible of low prices of sale to the consuming public, thereby making such stringed instrument neck having finger slots economically available to the buying public.

Still yet another object of the present invention is to provide a new stringed instrument neck having finger slots which provides in the apparatuses and methods of the prior art some of the advantages thereof, while simultaneously overcoming some of the disadvantages normally associated therewith.

Still another object of the present invention is to provide a new stringed instrument neck having finger slots for facilitating fingering chords when playing a guitar.

Yet another object of the present invention is to provide a new stringed instrument neck having finger slots which includes a main body portion having a bridge. A neck extends from the main body portion and includes a front face, a first end, a head portion and a medial portion extending between the first end and the head portion. The first end is coupled to the main body portion. A plurality of strings are coupled between the bridge and the head portion. The strings are positioned to extend substantially parallel to each other along the neck. The neck includes a plurality of finger slots extending substantially parallel to the strings. Each of the finger slots is positioned between an associated adjacent pair of the strings such that the neck is designed for permitting insertion of fingers of a user through the finger slots for facilitating selective clamping of the strings against the neck by the fingers of the user.

Still yet another object of the present invention is to provide a new stringed instrument neck having finger slots that allow a user to play easily and smoothly.

Even still another object of the present invention is to provide a new stringed instrument neck having finger slots that aid a user with finger positioning as well as provide a pattern in the chords shapes. This will eliminate the difficulty of playing chords.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
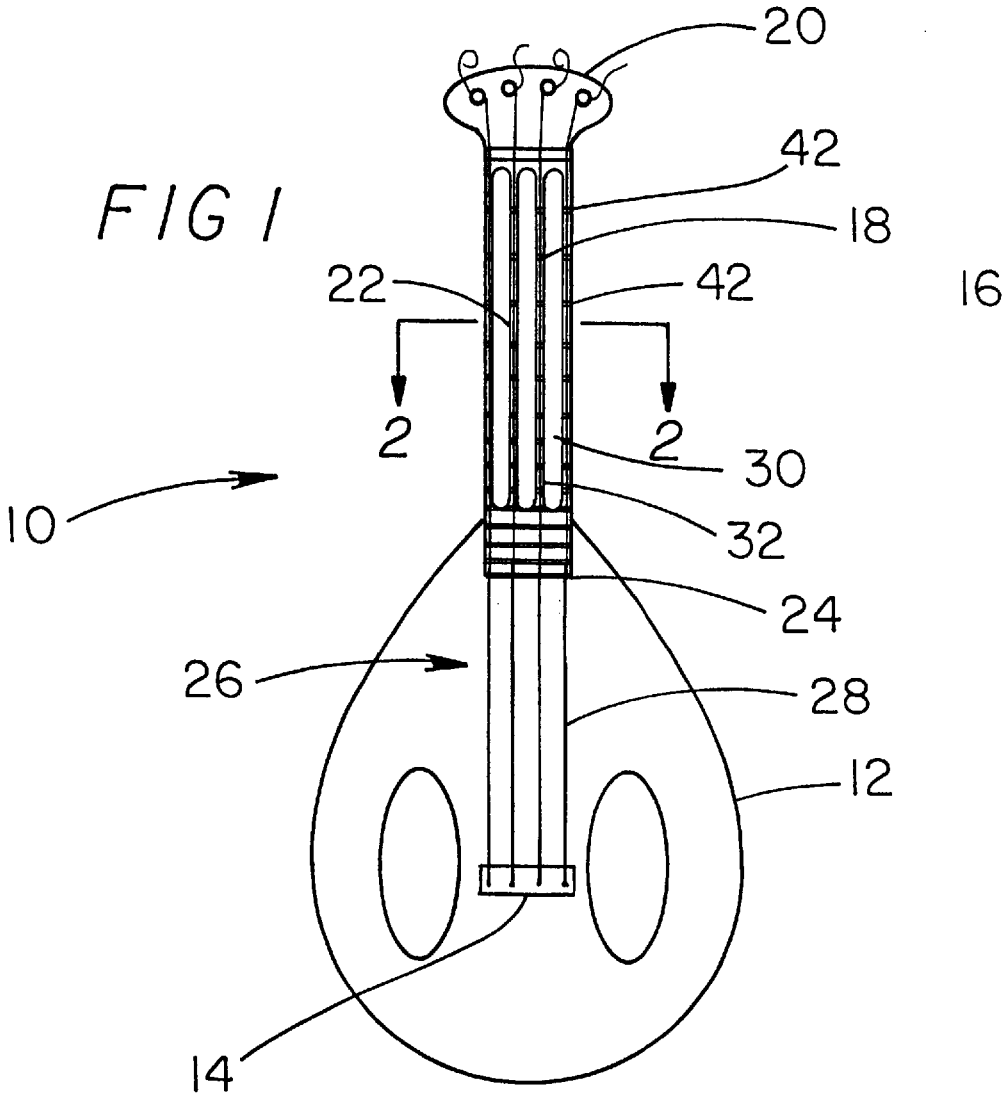
FIG. 1 is a top view of a new stringed instrument neck having finger slots according to the present invention.
Figure 2:
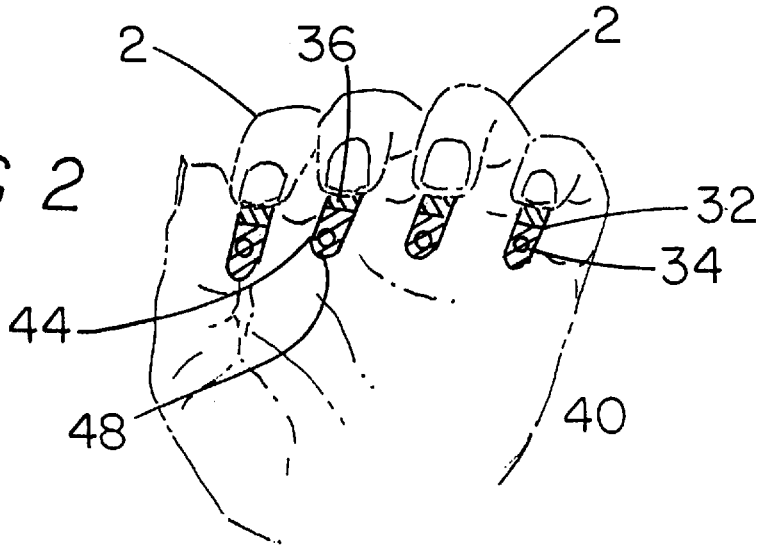
FIG. 2 is a cross-sectional view of the present invention taken along line 2—2 of FIG. 1.

With reference now to the drawings, and in particular to FIGS. 1 through 2 thereof, a new stringed instrument neck having finger slots embodying the principles and concepts of the present invention and generally designated by the reference numeral 10 will be described.

As best illustrated in FIGS. 1 through 2, the stringed instrument neck having finger slots 10 generally comprises a stringed instrument for facilitating fingering of musical chords. The stringed instrument includes a main body portion 12, which includes a bridge 14.

A neck 16 extends from the main body portion 12 and includes a front face 18, a first end 20, a head portion 20 and a medial portion 22 extending between the first end 24 and the head portion 20. The first end 24 is coupled to the main body portion 12. A plurality of strings 26 are coupled between the bridge 14 and the head portion 20. The strings 28 are positioned to extend substantially parallel to each other along the neck 16 in spaced relationship to the front face 18. The neck 16 includes a plurality of finger slots 30 extending substantially parallel to the strings 28. Each of the finger slots 30 is positioned between an associated adjacent pair of the strings 28 such that the neck 16 is designed for permitting insertion of fingers 2 of a user through the finger slots 30 for facilitating selective clamping of the strings 28 against the neck 16 by the fingers 2 of the user.

The finger slots 30 form a plurality of longitudinal string backing members 32 in the neck 16. Each of the string backing members 32 includes an associated reinforcing member 34 extending along a length of an interior of each the string backing member 32. Each of the string backing members 32 includes a planar face 36 coplanar to the front face 18 and a rounded rear face 40 for facilitating insertion of the fingers 2 of the user through the finger slots 30.

A plurality of spaced frets 42 extending transversely across each of the string backing members 32. The frets 42 of each string backing member 32 is substantially aligned with the frets 42 of an adjacent string backing member 32.

Each string backing member 32 includes a width measure orthogonally between opposite longitudinal sides 44 of the finger slot 30. Each finger slot 30 includes a width defined orthogonally between opposing longitudinal sides 48 of adjacent string backing members 32. The width of each the string backing members 32 is equal with respect to each other.

The width of each of the finger slots 30 is equal with respect to each other. The width of each of the finger slots 30 is about 4 times the width of each of the string backing members 32. Each of the string backing members extends away from the front face 18 of the neck 16 at an acute angle for facilitating insertion of the fingers 2 of the user through the finger slots 30 during use of the stringed instrument 10.

In use, a user would insert their fingers through the finger slots to finger appropriate chords to play the stringed instrument.

Variations of the present invention include having multiple strings extending along each string backing member. It is also contemplated that the instrument may be of the acoustic or electric variety. Various accessories may also be associated with the present invention to permit various modes of playing. The accessories include a metal cylinder for bouncing on the strings to provide vibration in the strings, a bow for drawing across one or more of the strings such that the instrument is played similar to a violin, or heads of the type used in pianos for striking the strings to play the instrument.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stringed instrument for facilitating fingering of musical chords, the stringed instrument comprising:

a main body portion having a bridge;

a neck extending from said main body portion, said neck having a front face, a first end, a head portion and a medial portion extending between said first end and said head portion, said first end being coupled to said main body portion;

a plurality of strings coupled between said bridge and said head portion, said strings being positioned to extend substantially parallel to each other along said neck; and said neck having a plurality of finger slots extending substantially parallel to said strings, each said finger slots being positioned between an associated adjacent pair of said strings such that said neck is adapted for permitting insertion of fingers of a user through said finger slots for facilitating selective clamping of said strings against said neck by the fingers of the user.

2. The stringed instrument of claim 1, further comprising:

said finger slots forming a plurality of longitudinal string backing members in said neck, each said string backing member having an associated reinforcing member extending along a length of an interior of each said string backing member.

3. The stringed instrument of claim 1, further comprising:

said finger slots forming a plurality of longitudinal string backing members in said neck, each said string backing member having a planar face and a rounded rear face for facilitating insertion of the fingers of the user through the finger slots.

4. The stringed instrument of claim 1, further comprising:

said finger slots forming a plurality of longitudinal string backing members in said neck; and a plurality of spaced frets extending transversely across each said string backing member.

5. The stringed instrument of claim 4, further comprising:

said frets of each said string backing member being substantially aligned with the frets of an adjacent string backing member.

6. The stringed instrument of claim 1, further comprising:

said finger slots forming a plurality of longitudinal string backing members in said neck, each said string backing member having a width measured orthogonally between opposite longitudinal sides of said finger slot;

each finger slot having a width defined orthogonally between opposing longitudinal sides of adjacent string backing members.

7. The stringed instrument of claim 6, further comprising:

said width of each said string backing member being equal with respect to each other; and said width of each said finger slot being equal with respect to each other.

8. The stringed instrument of claim 7, further comprising:

said width of each said finger slot being about 4 times said width of each said string backing member.

9. The stringed instrument of claim 1, further comprising:

said finger slots forming a plurality of longitudinal string backing members in said neck, each said string backing portion extending away from said front face of said neck and an acute angle for facilitating insertion of the fingers of the user through the finger slots during use of the stringed instrument.

10. A stringed instrument for facilitating fingering of musical chords, the stringed instrument comprising:

a main body portion having a bridge;

a neck extending from said main body portion, said neck having a front face, a first end, a head portion and a medial portion extending between said first end and said head portion, said first end being coupled to said main body portion;

a plurality of strings coupled between said bridge and said head portion, said strings being positioned to extend substantially parallel to each other along said neck in spaced relationship to said front face;

said neck having a plurality of finger slots extending substantially parallel to said strings, each said finger slots being positioned between an associated adjacent pair of said strings such that said neck is adapted for permitting insertion of fingers of a user through said finger slots for facilitating selective clamping of said strings against said neck by the fingers of the user;

said finger slots forming a plurality of longitudinal string backing members in said neck, each said string backing member having an associated reinforcing member extending along a length of an interior of each said string backing member;

each said string backing member having a planar face coplanar to said front face and a rounded rear face for facilitating insertion of the fingers of the user through the finger slots;

a plurality of spaced frets extending transversely across each said string backing member;

said frets of each said string backing member being substantially aligned with the frets of an adjacent string backing member;

each said string backing member having a width measured orthogonally between opposite longitudinal sides of said finger slot;

each finger slot having a width defined orthogonally between opposing longitudinal sides of adjacent string backing members;

said width of each said string backing member being equal with respect to each other; and said width of each said finger slot being equal with respect to each other;

said width of each said finger slot being about 4 times said width of each said string backing member; and each said string backing portion extending away from said front face of said neck and an acute angle for facilitating insertion of the fingers of the user through the finger slots during use of the stringed instrument.

* * * * *